US005281929A

United States Patent [19]

Willems

[11] Patent Number: 5,281,929

[45] Date of Patent: * Jan. 25, 1994

[54] MICROSTRIP TWISTED BROADSIDE COUPLER APPARATUS

[75] Inventor: David A. Willems, Salem, Va.

[73] Assignee: ITT Corporation, New York, N.Y.

[ * ] Notice: The portion of the term of this patent subsequent to Jan. 11, 2011 has been disclaimed.

[21] Appl. No.: 847,752

[22] Filed: Mar. 5, 1992

[51] Int. Cl.[5] ..... H01P 5/18

[52] U.S. Cl. ..... 333/116; 333/111

[58] Field of Search ..... 333/111, 116

[56] References Cited

U.S. PATENT DOCUMENTS

| | | | |
|---|---|---|---|
| 3,526,034 | 9/1970 | Beurrier | 333/118 X |
| 4,001,730 | 1/1977 | Spinner | 333/111 |
| 4,023,123 | 5/1977 | Reindel | 333/116 X |
| 4,482,873 | 11/1984 | Nyhus | 333/116 |
| 4,532,484 | 7/1985 | Tajima et al. | 333/116 |
| 4,967,171 | 10/1990 | Ban et al. | 333/204 X |
| 5,075,646 | 12/1991 | Moise | 333/116 |

*Primary Examiner*—Benny Lee

*Attorney, Agent, or Firm*—Arthur L. Plevy; Patrick M. Hogan

[57] ABSTRACT

A broadside microstrip coupler employs a first transmission line which consists of a series of capacitor plates which alternate between a dielectric layer from a first location to a second location and each of the series of plates are connected together with a top plate on the top surface of the dielectric and a bottom plate located a given distance beneath the dielectric layer. A second transmission line alternates between the top and bottom layers of the dielectric and consists of a second series of plates where each capacitor is connected to an adjacent plate with the top plate of the first connecting to the bottom plate of the second and the bottom plate of the first connecting to the top plate of the second and so on. This pattern is repeated so that the conductive plate path alternates from the top to the bottom plate. The coupler allows for tight coupling between inputs and outputs and enables the even and odd mode phase velocity differences to be compensated for due to the fact that the odd mode travels between the two conductors and the even mode travels between the conductor and the ground plate.

7 Claims, 3 Drawing Sheets

MICROSTRIP TWISTED BROADSIDE COUPLER APPARATUS

RELATED APPLICATIONS

Application entitled Broadband Microstrip Filter Apparatus filed on Feb. 13, 1992, Ser. No. 07/835,767 for D. A. Willems, the inventor herein and assigned to the assignee herein, describes a filter apparatus which employs coupling sections which are configured and fabricated according to some of the techniques described herein.

BACKGROUND OF THE INVENTION

Directional couplers are a very common element in RF and microwave systems. A directional coupler is a reciprocal, four-port circuit consisting of two pairs of ports in which (a) the ports of each pair are mutually isolated from one another, and (b) one pair of ports are matched. The ideal directional coupler takes power, which is incident at a first port, and transmits the power to two output ports with no transmitted power to a fourth port known as the isolated port. The quality of a coupler is measured by the insertion loss from an input port to an output port and by its directivity which is the ratios of power at the isolated port to the power at the coupler port.

Directional couplers operate on the principle of constructive and destructive interference of two waves. A signal at the input splits into two waves that arrive at the isolated port 180° out of phase with one another and therefore cancel one another. At the direct and coupled output ports, these waves arrive in phase with one another and interfere constructively. A directional coupler may be used as a power level monitor, a local oscillator injection device, an attenuator, a power combiner/divider, or a device to produce a fixed relative phase angle between two signals.

At high frequencies, directional couplers are implemented by allowing two transmission lines to couple. Such directional couplers have been made by means of mechanical designs, stripline, microstrip and other types of transmission medium, relatively popular in a microwave field. See a text entitled "Microwave Semiconductors Circuit Design" by W. Allan Davis published by Van Nostrand Reinhold Company, 1984, Chapter 2 entitled "Passive Microwave Components".

The stripline broadside coupler is widely used and employs well established technology. The broadside coupler gets its name because the broadside of flat conductors effect the coupling. Typically such conductors are a quarter wave length long. The reason why the broadsides are used for coupling is that coupling from the edges is insufficient to form heavily coupled devices, such as 3 dB couplers. Because the stripline coupler has two ground planes and a homogeneous dielectric, TEM propagation occurs and the even and odd phase velocities are identical which gives good bandwidth, directivity, and VSWR. It is understood that directivity is the measure of how much signal is present at the isolation port.

Another type of coupler in widespread use is the microstrip coupler. Microstrip has only one ground plane with the conductor supported by a layer of dielectric and therefore does not truly support TEM propagation. This type of coupler has two major problems. The first problem is the fact that it is very hard to manufacture a 3 dB coupler because the dimensional separation is very tight and therefore extremely critical. Prior art approaches have attempted to solve that problem by using interdigital techniques, as by interdigitating the coupler. The lack of true TEM propagation causes another problem. Because the even mode travels in the dielectric and the odd mode (the coupling fields between the conductors) travels in the air and dielectric the odd mode travels faster, reducing the directivity and bandwidth of the coupler. This is a major problem with microstrip.

It is desirable to use microstrip for a coupler as microstrip is used in a majority of microwave integrated circuits (MICs) and monolithic microwave integrated circuits (MMICs).

DETAILED DESCRIPTION OF THE FIGURES

Figure 1:
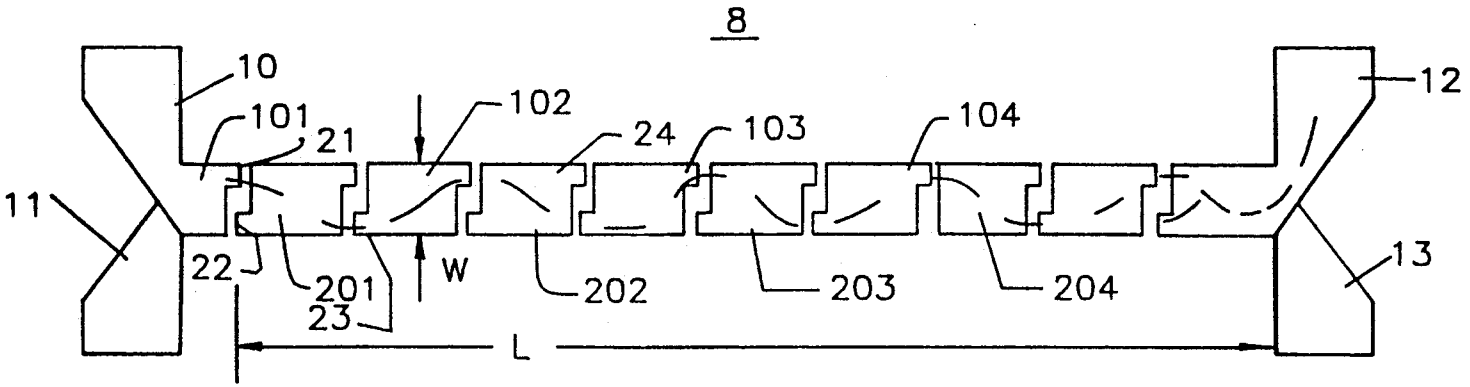
FIG. 1 is a top plan view of a broadside coupler according to this invention.
Figure 2:
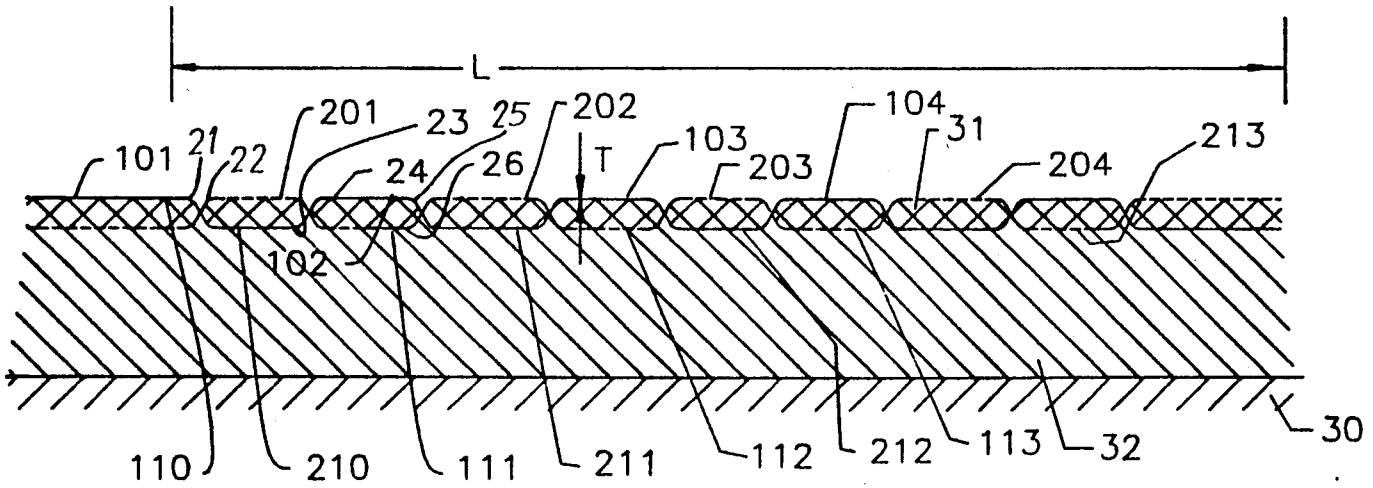
FIG. 2 is a sectional view of the coupler of FIG. 1.
Figure 3:
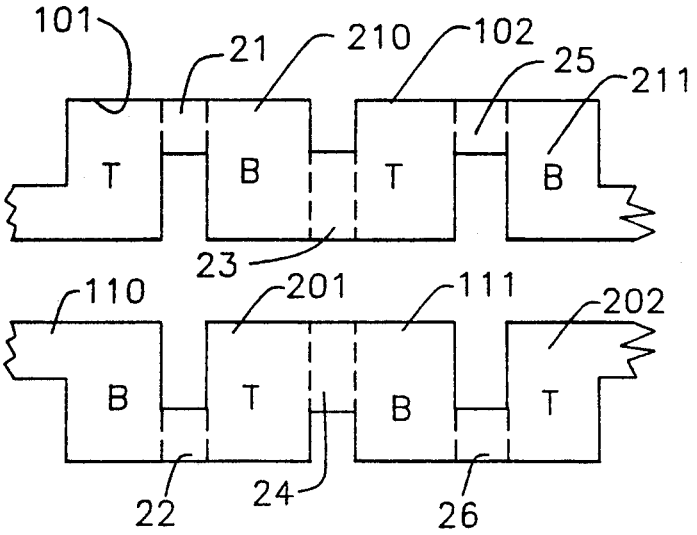
FIG. 3 is a top plan view of first and second transmission lines forming the coupler according to this invention.
Figure 4:
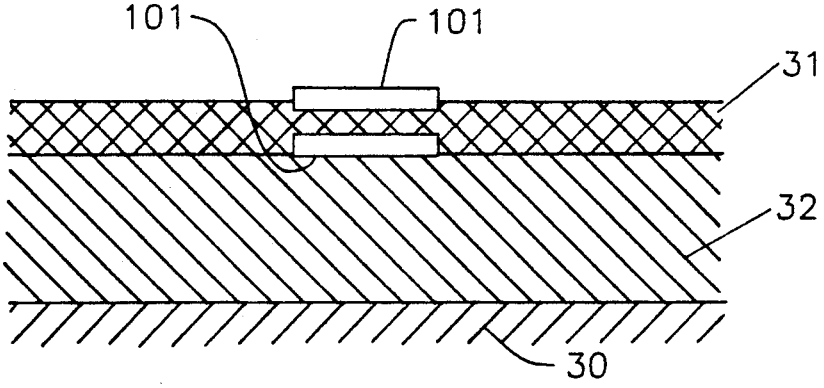
FIG. 4 is a cross-sectional view of a portion of the coupler.

FIG. 1 is a top view of a microstrip structure according to this invention. FIG. 2 is a side view of the microstrip structure depicted in FIG. 1, and FIG. 3 is a top view showing a first line section separated from a second line section which are employed to fabricate the broadside coupler according to this invention. FIG. 4 shows a sectional view of the microstrip broadside coupler according to this invention.

Referring to FIG. 1 there is shown a top view of a microstrip twisted broadside coupler. The coupler, as indicated, is of microstrip configuration which essentially consists of a semi-insulating semiconductor or dielectric (not shown herein) having positioned on the top surface of the semiconductor an alternating conductor pattern. Basically a microstrip configuration consists of a strip conductor of width W and thickness T on a dielectric (gallium arsenide GaAs) substrate with the backside metalized to form a ground plane. Apart from gallium arsenide substrates one can employ alumina substrates and other materials as well.

Microstrip (MS) is the most popular transmission line configuration for monolithic IC applications due to the following:

1. Passive and active elements are easily inserted in series with the MS strip conductor on the surface of the chip.

2. The metalized ground plane on the back of the substrate can be used both as a mounting surface and as the heat sink for heat generated by the active devices on a substrate.

3. A large body of theoretical and experimental data exists for the microstrip configuration.

4. The losses and dispersions are low while the output impedance range is moderate.

A disadvantage of microstrip is due to its non-coplanar geometry which makes it difficult to connect elements in shunt to ground. Microstrip techniques are well known and have been widely utilized in both the technology involving microwave integrated circuits (MICs) and monolithic microwave integrated circuits (MMICs). As above indicated, the structure to be described can use the same techniques which are employed for the co-pending application depicted above and entitled "Broadband Microstrip Filter Apparatus" (Willems-8).

FIG. 1 shows a top plan view of a microstrip twisted broadside coupler 8 according to this invention. There is shown a first input port 10 which is metalized area deposited on the substrate (not shown) and is adapted to receive an input signal. The coupler has two outputs designated as 12 and 11, respectively called a direct output and a coupled output. The remaining port, designated 13, is the isolated port. As previously described, the direction coupler works as follows. Power applied to input port 10 is transmitted to ports 12 and 11 with no power transmitted to port 13. As will be described, the coupler consists of a first and a second transmission line, each transmission line is capacitively coupled to the other. The lines basically consist of a configuration of alternating capacitor plates. Each capacitor plate in a line is connected to an adjacent capacitor with the top plate of the first connecting to the bottom plate of the second and the bottom plate of the first connecting to the top plate of the second. This is repeated so that the conductor path alternates from the top plate to the bottom plate.

Thus, as shown in FIG. 1, the input port 10 is connected to a first capacitive plate 101, plate 101 is part of the first transmission line and is shown in FIG. 3 wherein the dashed area indicates a relatively rectangular plate 101 also designated by the reference numeral T for top plate. The first top plate 101 then extends is connected to a bottom plate 210 by means of a via or conducting strip 21 which extends down into the substrate, as shown in the cross section in FIG. 2. FIG. 1 also depicts the connection of top plate 201 to via 21. The bottom plate 210 is of the same size and geometric configuration as the top plate 101 and is also designated by the reference numeral B for bottom (see FIG. 3). The bottom plate 210 again is connected to another top plate 102 which is shown in FIG. 1 in conjunction with FIG. 3 as part of the first line by means of the via 23. The top plate 102 is again connected to another bottom plate 211 by means of the via 25. The connection of bottom plate 210 to top plate 102 by means of via 23 is also shown in FIG. 2. This pattern alternates, as shown in FIG. 2 in conjunction with FIGS. 1 and 3, from a top plate 101 to the bottom plate 210 to the top plate 102 to the bottom plate 211 to the top plate 103 to the bottom plate 212 to the top plate 104 to the bottom plate 213 and so on, for the first transmission line. FIG. 1 illustrates the top view of the coupler 8, wherein the top plates 101, 102, 103 and 104 are part of the first transmission line. The alternating pattern of the first transmission line is also shown in FIG. 3, wherein top plate 101 is connected to bottom plate 210 by via 21, bottom plate 210 is connected to top plate 102 by via 23, and top plate 102 is connected to bottom plate 211 by via 25.

In a similar manner, the second transmission line consists of alternating top and bottom plates. As shown in FIG. 1, there is a top plate 201 associated with the second transmission line which also includes top plate 202, top plate 203 and top plate 204. These top plates are shown in dashed lines in FIG. 2, and each top plate in FIG. 2 and FIG. 1 is connected to a respective bottom plate through a via. Hence, as shown in both FIGS. 2 and 3 in conjunction with FIG. 1, the second line includes a first top plate 201 which is connected to a bottom plate 110 by means of via 22. The connection of top plate 201 to via 22 is also illustrated in FIG. 1. The top plate 201 is also connected to another bottom plate 111 by means of via 24. The bottom plate 111 is then connected to another top plate 202 by means of via 26 and so on. The input section 10 is connected to the first plate 101 of the first line, the coupled section 11 is coupled to the plate 110 of the second line. The direct output section 12 is connected to the first line, while the isolated section 13 is connected to the second line. As shown in FIGS. 1 and 3, the first and second transmission lines are made up of capacitors having a length 1 equal to a quarter wavelength at a specified microwave frequency. As shown in FIG. 1, these capacitors have a width, W.

As one can see from FIG. 3, the first line is a mirror image of the second line and each consists of alternating top and bottom plates which are connected together through vias such as 21, 22, 23, 24 and 25 and which provides the alternating pattern shown in FIG. 1 and FIG. 2. FIG. 2 clearly shows a cross-sectional view depicting a typical microstrip section. It is noted that there is a ground plane 30 which is conventionally formed by a typical metal process. Upon the ground plane 30 is a dielectric layer 32 which, as indicated, may be of gallium arsenide or alumina or some other suitable dielectric. There is a dielectric layer 31 which separates each top and bottom plate to thereby form a capacitor between a top plate of the first line and a bottom plate of the second line.

Thus, as seen for example in FIG. 2, there is a first capacitor which consists of top plate 101 and bottom plate 110. The top plate 101 is associated with the first line, with the bottom plate 110 associated with the second line. The top plate 101 is connected to a bottom plate 210 associated with the first line which bottom plate 210 is associated with a top plate 201 associated with the second line. Thus, as one can see, the configuration produces a series of capacitors. Each capacitor has a top plate and a bottom plate. A first capacitor consists of a top plate 101 and a bottom plate 110. The second capacitor consists of a top plate 201 and a bottom plate 210. A third capacitor consists of a top plate 102 and a bottom plate 111 and so on. Each of the top and bottom plates alternate from the input to the output end and constitute portions of respective lines.

Another way of looking at the configuration is considering it to be a pair of broadside coupler lines that are twisted or, from a fabrication standpoint, a long capacitor that is twisted. By switching from the top to the bottom each conductor averages the same distance from the ground plane insuring identical impedances in each of the transmission lines. Hence, the first transmission line essentially is of the same length as the second transmission line and is basically a mirror image of the same. In this manner, the dashed line sinusoidal waveform shown in FIG. 1 indicates a coupling from the input to the direct terminal 12 which indicates a path for the coupler.

To eliminate the poor directivity inherent in microstrip couplers, the even and odd mode phase velocities must be equalized. This equalization is achieved by two different phenomenons. First, by using the capacitor-like structure, the field tends to be contained in the dielectric between the plates instead of the air. Second, the odd mode velocity can be slowed by alternating from side to side the conductor or capacitor connections to force the odd mode to travel in the path depicted by the dotted line in FIG. 1. Essentially the signal enters the capacitor plate on one side and exits on the other. Because the odd mode travels between the two conductors and the even mode travels between the conductor and the ground plane, the odd mode travels faster but also travels a farther distance. Thus the odd and the even mode move down the complete transmission line structure in synchronism.

As shown in FIG. 4, there is a cross-sectional view showing a top plate of a capacitor 101 and a bottom plate of a capacitor 110 separated by the dielectric layer 31 which is positioned on top of dielectric layer 32, both of which are positioned on top of the ground plane 30. The dielectric layer 31 that separates the conductors, which constitute the first and second transmission lines, is preferably not the same layer as the dielectric layer 32 that separates the conductors from the ground plane 30. This dielectric layer 31 can be varied in width across the length to therefore adjust the coupling between capacitors and so on. In a typical fabrication process, the dielectric is spread over the entire surface. This would be for easy fabrication but it is of course understood that this particular feature is not necessary.

Figure 5:
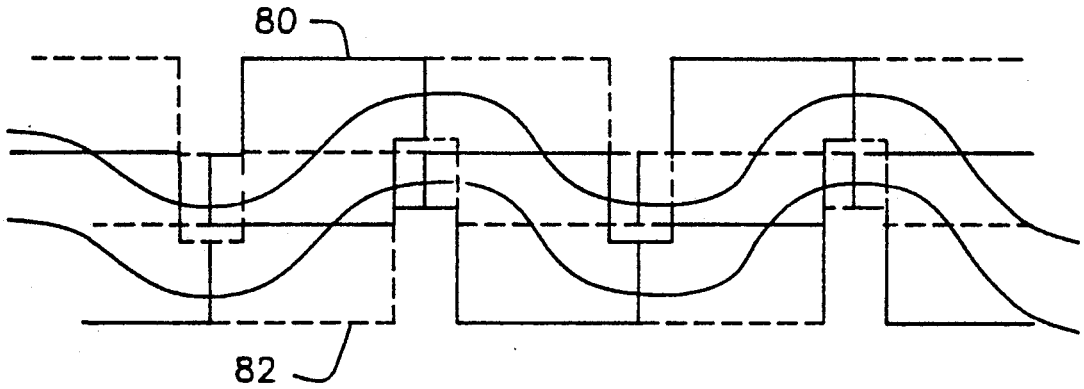
FIG. 5 is a top plan view of an alternate embodiment of the coupler.

The odd mode phase velocity can be adjusted by changing the aspect ratio of the segments which changes the path length. For example, if a 1 mil×1 mil segment is changed to two 1 mil×½ mil segments, the path length is more than doubled for the odd mode. The coupling can also be adjusted by changing the dielectric thickness 31 between the plates or by offsetting the conductors, as shown in FIG. 5. In FIG. 5 there is shown a first and a second transmission line which essentially have offset conductors but which still provide capacitive coupling.

FIG. 5 shows an alternate embodiment of the structure whereby a first transmission capacitor line 80 is coupled to a second line 82 wherein the capacitive plates are offset one from the other to provide coupling between the plates as desired and according to the offset. The sinusoidal patterns, as shown in FIG. 5, show an odd mode path between the top and bottom transmission lines. FIG. 5 depicts a top view looking down on a substrate with the visible conductor represented as a solid line and the dotted line representing the conductor which is beneath the dielectric. By offsetting the conductors one maintains the equalization of the even and odd mode phase velocities and further maintains the exact or equivalent lengths of the transmission line to insure proper impedance value while further enabling the offset conductors to determine the exact coupling between the capacitive plates, thereby eliminating the need for a varying thickness dielectric.

The twisted broadside coupler essentially consists of the first and second lines each of which are a quarter wavelength at the desired operating frequencies or at a desired operating center frequency. The device is very simple to construct and one may first deposit upon a microstrip substrate bottom plates in, for example, an etched channel or other etched edifice then one covers the bottom plate with a dielectric layer upon which is deposited top plates with the holes to accommodate the via metalization formed during the first or second depositions by well-known semiconductor deposition techniques.

Such techniques are widely known. See a text entitled "GaAs Integrated Circuit-Design & Technology" by J. Mun (1988) MacMillan Publishing Co.

What is claimed is:

1. A broadband microstrip coupler apparatus, comprising:

a microstrip structure having a first end and a second end and having a ground plane with a dielectric disposed thereon, to realize a microstrip substrate, said microstrip substrate having a top surface comprised of said dielectric, a first conductive line having a first plurality of conductive areas and a second plurality of conductive areas, said first plurality of conductive areas located on said top surface of said substrate and said second plurality of conductive areas located a given distance beneath said top surface of said substrate, each separate first and second conductive area having a leading edge and a trailing edge and wherein each of said first conductive areas has a respective trailing edge connected to the leading edge of an adjacent second conductive area, and each of said adjacent second conductive areas has a respective trailing edge trailing edge connected to the leading edge of a next adjacent first conductive area, all of said first plurality of conductive areas being thereby connected with all of said second plurality of conductive areas to realize said first conductive line having a square wave pattern;

a second conductive line having a third plurality of conductive areas and a fourth plurality of conductive areas, said third plurality of conductive areas located on said top surface of said substrate and said fourth plurality of conductive areas located said given distance beneath said top surface of said substrate, each separate third and fourth conductive area having a leading edge and a trailing edge and wherein each of said third conductive areas has a respective trailing edge connected to the leading edge of an adjacent fourth conductive area, and each of said adjacent fourth conductive areas has a respective trailing edge connected to the leading edge of a next adjacent third conductive area, all of said third plurality of conductive areas being thereby connected with all of said fourth plurality of conductive areas to realize said second conductive line having a square wave pattern, said conductive areas of said first conductive line being disposed relative to said conductive areas of said second conductive line to realize an interlace pattern therebetween, said third plurality and said second plurality of conductive areas being thereby constituted as a first plurality of capacitors wherein each one of said third conductive areas of said second line constitutes a respective top capacitive plate and a respective one of said second conductive areas of said first line constitutes an associated bottom capacitive plate, said first plurality and said fourth plurality of conductive areas being thereby constituted as a second plurality of capacitors wherein each one of said first conductive areas of said first line constitutes a respective top capacitive plate and a respective one of said fourth conductive areas of said second line constitutes an associated bottom capacitive plate, wherein said first and said fourth conductive areas and said second and said third conductive areas, respectively are disposed relative to one another so that said leading and trailing edges of each of said first conductive areas are essentially coincident respectively with said leading and trailing edges of each of said fourth conductive areas and said leading and trailing edges of said second conductive areas are essentially coincident respectively with said leading and trailing edges of said third conductive areas; and wherein an input microwave signal is applied to said microstrip coupler apparatus and propagates along said first and second lines, and said microwave signal has an odd mode wave propagating between said first and said second lines and an even mode wave propagating between said first line and said ground plane and between said second line and said ground plane, respectively, and whereupon said even and said odd mode waves travel in synchronism from said first end to said second end of said microstrip coupler apparatus.

2. The coupler apparatus according to claim 1, wherein said first and second lines each include a given number of said capacitors, each of said conductive lines having a length equal to a quarter wavelength at a frequency of said input microwave signal.

3. The coupler apparatus according to claim 2 further including an input port having one end coupled to said first line for accepting said input microwave signal applied to said coupler apparatus.

4. The coupler apparatus according to claim 3 further including a direct output section having one terminal coupled to said first line for providing a direct output signal for said coupler.

5. The coupler apparatus according to claim 1 wherein said substrate of said microstrip structure is comprised of GaAs.

6. The coupler apparatus according to claim 1 wherein said dielectric between said first and said fourth conductive areas has a predetermined thickness according to the amount of coupling desired.

7. The coupler apparatus according to claim 1, wherein said dielectric between said second and third conductive areas has a predetermined thickness according to the amount of coupling desired.

* * * * *